US010329056B2

(12) United States Patent
Noer

(10) Patent No.: US 10,329,056 B2
(45) Date of Patent: Jun. 25, 2019

(54) LID LEVER FOR CONTAINER

(71) Applicant: RPC SUPERFOS A/S, Taastrup (DK)

(72) Inventor: Torben Noer, Malling (DK)

(73) Assignee: RPC SUPERFOS A/S, Taastrup (DK)

( * ) Notice: Subject to any disclaimer, the term of this patent is extended or adjusted under 35 U.S.C. 154(b) by 164 days.

(21) Appl. No.: 15/525,211

(22) PCT Filed: Nov. 8, 2015

(86) PCT No.: PCT/EP2015/076001
§ 371 (c)(1),
(2) Date: May 8, 2017

(87) PCT Pub. No.: WO2016/071527
PCT Pub. Date: May 12, 2016

(65) Prior Publication Data

US 2017/0334610 A1 Nov. 23, 2017

(30) Foreign Application Priority Data

Nov. 7, 2014 (DK) ..... 2014 70680

(51) Int. Cl.
*B65D 43/02* (2006.01)
*B65D 47/24* (2006.01)

(52) U.S. Cl.
CPC ..... *B65D 43/02* (2013.01); *B65D 43/0204* (2013.01); *B65D 47/249* (2013.01);
(Continued)

(58) Field of Classification Search
CPC .. B65D 43/02; B65D 47/249; B65D 43/0204; B65D 2543/00685; B65D 2543/00629;
(Continued)

(56) References Cited

U.S. PATENT DOCUMENTS 1,562,837 A 11/1925 Lindemann
1,871,677 A 8/1932 Ermold
(Continued)

FOREIGN PATENT DOCUMENTS

CA 2361685 A1 * 8/2000 ..... B65D 43/0212
DE 9205256 7/1992
(Continued)

OTHER PUBLICATIONS

English Abstract of DE 202007008781—(DE 202006010571).

*Primary Examiner* — James N Smalley
(74) *Attorney, Agent, or Firm* — Dykema Gossett PLLC

(57) ABSTRACT

A container (100) with a lid lever (132) to disengage a lid present on a rim portion (112) of the container (100) is disclosed. The lid lever (132) is integrated between two cuts and is attached to a primary skirt (114) of the container (100). The lid lever (132) is pulled laterally outward towards a free end to disengage the lid. A secondary skirt (138) in the form of a flange is present behind the lid lever (132). The secondary skirt (138) prevents deformation of the primary skirt (114) and the rim portion (112) of the container (100). The shape of the lid lever (132) extends past the primary skirt (114) thereby making the lid lever (132) more effective and further makes it distinguishable from the primary skirt (114).

13 Claims, 6 Drawing Sheets

(52) U.S. Cl.
CPC ..... *B65D 2101/0015* (2013.01); *B65D 2543/00092* (2013.01); *B65D 2543/00296* (2013.01); *B65D 2543/00629* (2013.01); *B65D 2543/00685* (2013.01); *B65D 2543/00888* (2013.01); *B65D 2543/00944* (2013.01)

(58) Field of Classification Search
CPC ..... B65D 2543/00296; B65D 2543/00092; B65D 2543/00944; B65D 2543/00888; B65D 2101/0015
USPC ..... 220/285
See application file for complete search history.

(56) References Cited

U.S. PATENT DOCUMENTS

| | | | | |
|---|---|---|---|---|
| 3,773,208 | A | 11/1973 | Curry | |
| 6,644,492 | B1 | 11/2003 | Mitchell | |
| 7,475,789 | B2 | 1/2009 | Fischer | |
| 7,731,049 | B2 * | 6/2010 | Dengel | B65D 43/0212 215/47 |
| 2004/0011791 | A1 * | 1/2004 | Oh | B65D 43/021 220/285 |
| 2007/0062948 | A1 * | 3/2007 | Albrecht | B65D 43/0212 220/266 |
| 2008/0179337 | A1 | 7/2008 | Vuillot et al. | |
| 2008/0257886 | A1 * | 10/2008 | Luburic | B65D 43/0212 220/285 |
| 2013/0098914 | A1 * | 4/2013 | Pudselykke | B65D 43/0212 220/270 |

FOREIGN PATENT DOCUMENTS

| | | |
|---|---|---|
| DE | 202006010571 | 10/2006 |
| EP | 1052183 | 11/2000 |
| EP | 1122184 | 8/2001 |
| EP | 1871677 | 10/2006 |
| EP | 1562837 | 2/2007 |
| WO | 2003013967 | 2/2003 |
| WO | 03076286 | 9/2003 |
| WO | 03076287 | 9/2003 |
| WO | 2003076286 | 9/2003 |
| WO | 2006111158 | 10/2006 |

* cited by examiner

SECTION X-X'

SECTION Y-Y'

LID LEVER FOR CONTAINER

The current invention relates to a container with a lid lever. More particularly, the current invention relates to providing a lid lever for a container for effectively detaching a lid mounted on the container without any damage.

DESCRIPTION OF RELATED ART

The use of air tight containers for various industrial and domestic applications is very well documented. Various agro based and chemical industries use air tight containers for storing food products and chemicals. Air tight containers ensure that the substance stored inside the container retains its original properties and does not get spoiled. The lid of the container needs to be tightly engaged to the rim of the container so as to make the container air tight. Hand tools such as screw drivers are often used to open the lid of such containers since the lid is so tightly attached to the container. Using a screwdriver will in most cases damage the lid. While it is usually still possible to attach the lid to the container after opening, the damaged lid will result in a poorer seal.

Various methods and devices have been used in the past to provide lid levers which can be used to remove a lid while maintaining the air sealing property of the container. U.S. Pat. No. 3,773,208 by Curry J describes a foldable portion integrated within the skirt portion which makes it possible to reposition the cover on the container with maintained sealing action after the cover has been removed from the container. European Patent No 1,483,163 by Kjeld Nielsen talks about a flap which is manually pulled to lift the lid from the edge of the rim of the container.

In another example, a container has a skirt portion for providing stiffness to the rim portion of the lid as disclosed in European Patent No 1,052,183 by Holger Thorso. However, when the lid lever is introduced into the skirt container, the skirt portion is broken by cuts in the skirt portion allowing the lid lever to pivot outwardly towards the free end. These cuts effectively break the skirt portion and reduce the stiffening effect of the skirt portion which further reduces the sealing property of the container.

Another European Patent, No. 1,562,837 by Ronald Fischer describes an opening mechanism for a bucket where a more steady unlatching lifting movement of the lid is achieved. Similarly European Patent No 1,871,677 talks about a device for releasing the lid of the container. None of the prior art documents ensure structural integrity of the rim and the skirt of the container.

In other examples, lid levers are generally integrated within the skirt of the container as disclosed in for example U.S. Pat. No. 6,644,492 by Paul Bernard Mitchell. The patent discloses the use of lid levers to disengage a lid from the rim of the container. Many times people don't see the lid lever as it is integrated within the skirt and they then use screw drivers to force the lid open. When doing this they often deform the rim of the container, thereby reducing its effectiveness.

In light of the foregoing discussion, there exists a need for providing an innovative lid lever mechanism for disengaging the lid from the container. Moreover there is a need for providing a lid lever which utilizes the effort of the user in lifting the lid rather than deforming the rim of the container.

SUMMARY OF THE INVENTION

An object of the present invention is to provide a container with an integrated lid lever where the lid lever is more effective than prior art containers with lid levers. The lid lever is integrated into the container between two cuts formed in a primary skirt. According to this specification, the word "cuts" should be interpreted to include weakened areas which can be broken when force is applied, for example perforations, lines having a very thin wall section, etc.

Another object of the present invention is to provide effective lifting of the lid by designing the lid lever such that it protrudes past an outer surface of the primary skirt of a container. This makes the lid lever more effective as well as making it more distinguishable from the primary skirt thereby making it easy to locate.

Yet another object of the present invention is to provide a lid lever which provides additional stiffness to the rim portion and the primary skirt of the container while detaching a lid therefrom.

According to the present invention, a container is provided according to the introductory portion of claim 1, wherein the lid lower edge engaging surface of the lid lever is arranged in such a way that the outer edge of the lid lower edge engaging surface of the lid lever extends outwardly past a circular line which is co-centric with and which has the same diameter as the outer edge of the lid lower edge engaging surface of the primary skirt.

An additional invention is disclosed in the additional independent claim 4. In this second invention, a container is provided according to the introductory portion of claim 4 with a secondary skirt in the area between the two cuts in the primary skirt. The primary skirt circumferentially surrounds and protects a rim portion of the container. The secondary skirt lightens the load taken by the rim portion of the container and primary skirt when the lid lever is pulled to detach a lid. The secondary skirt maintains the structural integrity of the lid, primary skirt and the rim portion of the container.

Additional advantageous embodiments are disclosed in the dependent claims.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the present invention will be described in greater detail with reference to embodiments shown by the enclosed figures. It should be emphasized that the embodiments shown are used for example purposes only and should not be used to limit the scope of the present invention.

DETAILED DESCRIPTION OF THE EMBODIMENTS

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present invention.

There may be additional components described in the current application that are not depicted on one of the described drawings. In the event such a component is described, but not depicted in a drawing, the absence of such a drawing should not be considered as an omission of such design from the specification.

Before describing the present invention in detail, it should be observed that the present invention utilizes a combination of system components which constitutes a container with an integrated lid lever for effectively disengaging a lid from a rim portion of the container. Accordingly, the components and the method steps have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the present invention.

Figure 1:
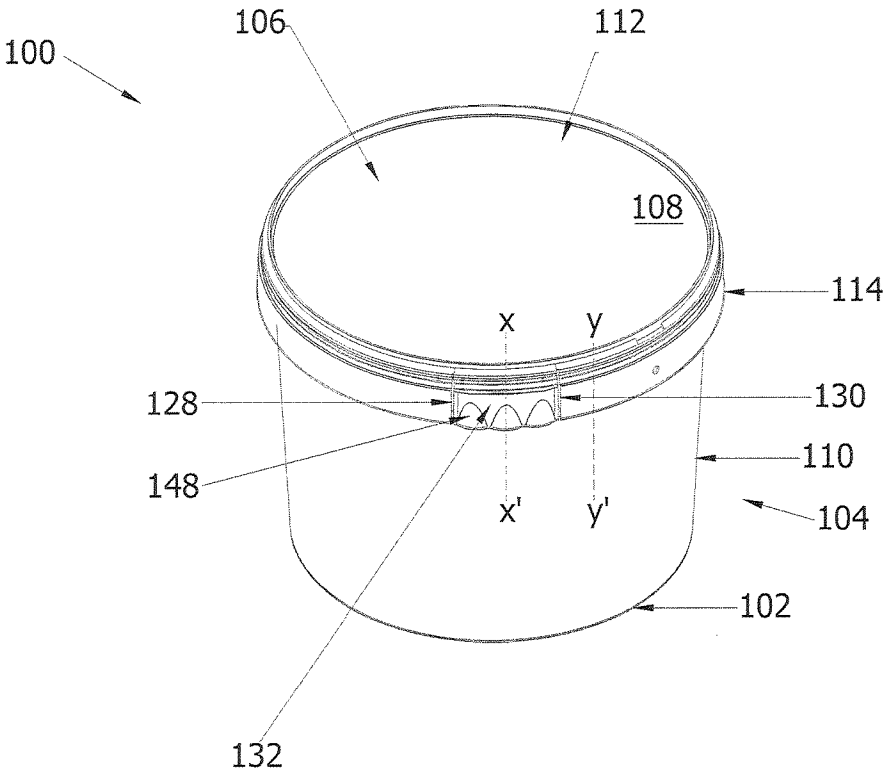
FIG. 1 shows a perspective view of a container along with a lid lever, according to an illustrative embodiment of the present invention.

A perspective view of a container 100 is shown in FIG. 1 according to an illustrative embodiment of the present invention. The container 100 has a bottom portion 102 and a sidewall portion 104 extending from the bottom portion 102. The area surrounded by an upper edge of the sidewall portion 104 provides an opening 106 at the top. The opening 106 is configured to be covered by a lid (not shown in the figures). The sidewall portion 104 further comprises an inner surface 108, an outer surface 110 and a rim portion 112. The rim portion 112 is present on the upper edge of the sidewall portion 104.

The container 100 further includes a primary skirt 114 which extends downward from the rim portion 112 of the container 100 and covers the majority of the circumference of the container 100. The primary skirt 114 comprises an inner surface 116 and an outer surface 118. The primary skirt 114 includes a first set of ribs 120 which extends from the inner surface 116 of the primary skirt 114 to the outer surface 110 of the sidewall portion 104. The first set of ribs 120 are placed at regular intervals around the circumference of the container 100. The first set of ribs 120 fixedly attaches the primary skirt 114 to the outer surface 110 of the sidewall portion 104 providing additional stiffness to the rim portion 112.

Figure 3:
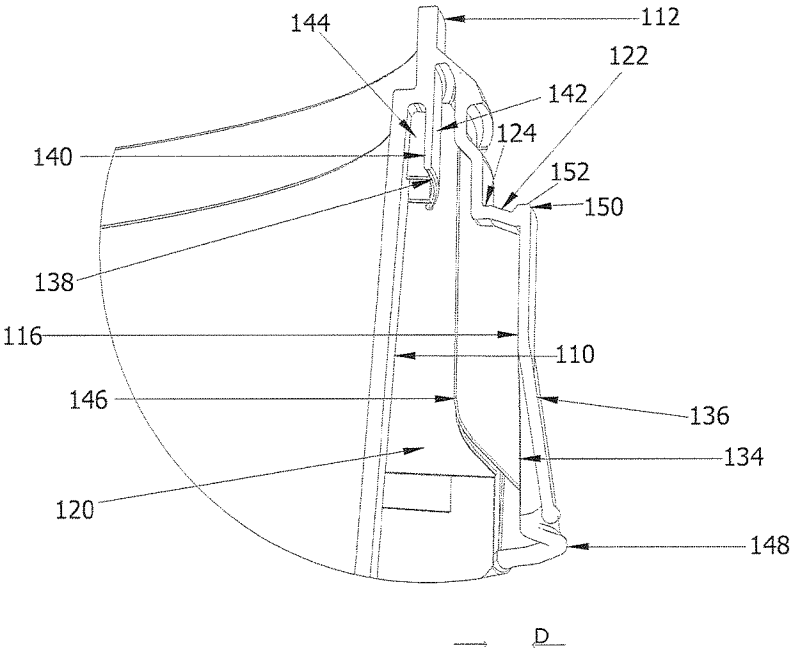
FIG. 3 shows a sectional view of the portion between the first cut and the second cut along the X-X' axis shown in FIG. 1, according to an illustrative embodiment of the present invention.
Figure 4A:
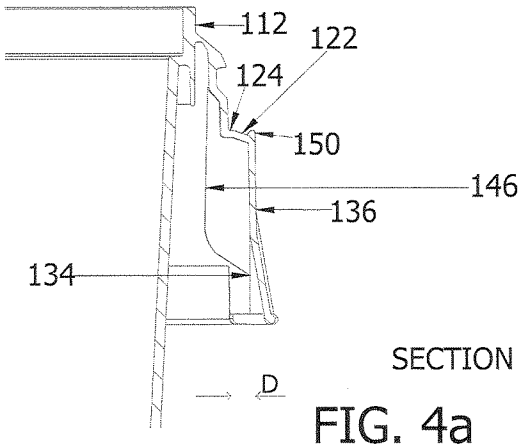
FIG. 4*a* shows a sectional side view of a portion of the lid lever between the first cut and the second cut along the X-X' axis shown in FIG. 1, according to an illustrative embodiment of the present invention.
Figure 4B:
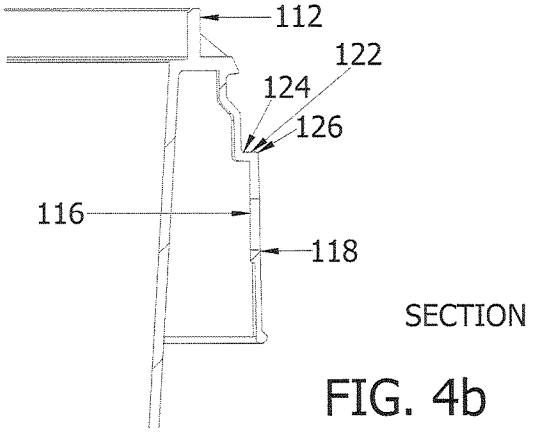
FIG. 4*b* shows a sectional side view of a portion of the primary skirt along the Y-Y' axis shown in FIG. 1, according to an illustrative embodiment of the present invention.

The primary skirt 114 provides stiffness to the rim portion 112 of the container 100. The primary skirt 114 further includes a lid lower edge engaging surface 122 having an inner edge 124 and an outer edge 126 as shown in FIG. 3, FIG. 4*a* and FIG. 4*b*. A lower edge of the lid (not shown in figures) rests on the lid lower edge engaging surface 122 when the lid is mounted on the container 100. The lower edge of the lid of the container 100 is thereby protected by the lid lower edge engaging surface 122. If the lid lower edge engaging surface 122 were not present, then there exists a risk that when one sets the container 100 next to another container (not shown in figures), the lower edge of the lid could get caught on an upper edge (not shown in figures) of an adjacent container and the lid of the container 100 would then be lifted off. Hence, to avoid this, the lower edge of the lid is hidden by the outer surface 118 of the primary skirt 114.

The primary skirt 114 comprises a first cut 128, a second cut 130 and a lid lever 132 is then integrated between the first cut 128 and the second cut 130 as shown in FIG. 1. The lid lever 132 comprises an inner surface 134 and an outer surface 136. The lid lever 132 is configured to dislodge the lid secured on the rim portion 112 of the container 100 when the lid lever 132 is pivoted outwardly as will be described in more detail below.

Figure 2:
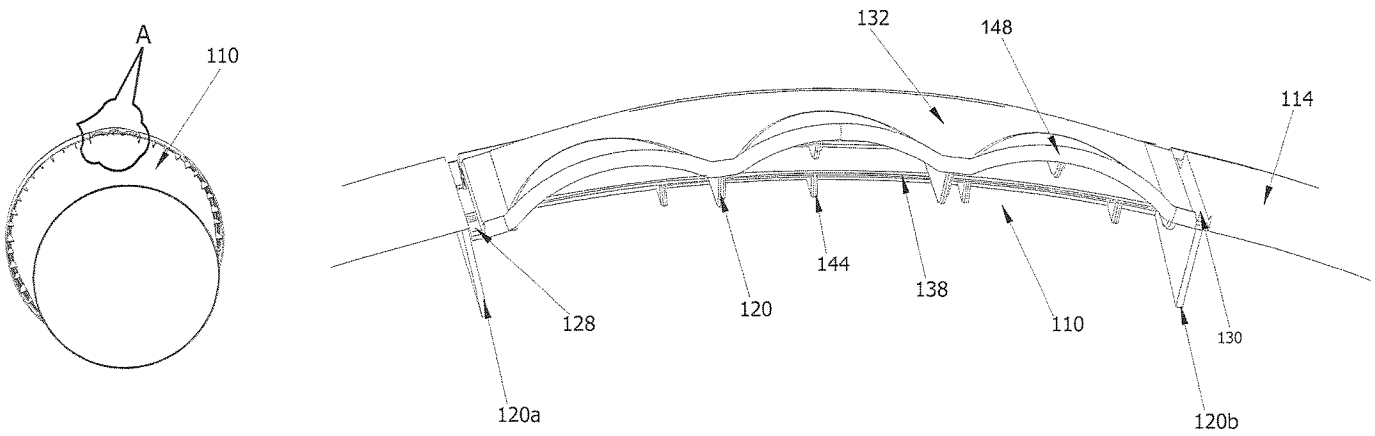
FIG. 2 shows a perspective view of a portion between a first cut and a second cut, according to an illustrative embodiment of the present invention.

A perspective view of a portion between the first cut 128 and the second cut 130 is shown in FIG. 2 according to an illustrative embodiment of the present invention. The lid lever 132 is integrated between the first cut 128 and the second cut 130. The container 100 further comprises a secondary skirt 138 along the circumference of the upper edge of the sidewall portion 104. The secondary skirt 138 comprises an inner surface 140 and an outer surface 142. The secondary skirt 138 extends downward from the rim portion 112 of the container 100. The secondary skirt 138 is positioned between the inner surface 134 of the lid lever 132 and the outer surface 110 of the sidewall portion 104 between the first cut 128 and the second cut 130.

The secondary skirt 138 is positioned as a flange according to an illustrative embodiment of the present invention. A perspective sectional view of the portion between the first cut 128 and the second cut 130 along the X-X' axis of FIG. 1 is shown in FIG. 3 according to an illustrative embodiment of the present invention. The secondary skirt 138 also includes a second set of ribs 144 to stiffen the construction of the lid lever 132.

The secondary skirt 138 is integrated within the primary skirt 114 between the first cut 128 and the second cut 130. A first rib 120*a* of the first set of ribs 120 is adjacently placed beside the first cut 128 and a second rib 120*b* of the first set of ribs 120 is adjacently placed beside the second cut 130 respectively as shown in FIG. 2. The secondary skirt 138 is placed between these two ribs 120*a*, 120*b*. In the current embodiment, the secondary skirt 138 is connected to the first rib 120*a* at its one end and to the second rib 120*b* at its other end. The ribs of the first set of ribs 120 are present around the circumference of the rim portion 112 of the container 100, but not including the area between the first cut 128 and the second cut 130.

Ribs from a second set of ribs 144 extend from an inner surface 140 of the secondary skirt 138 to the outer surface 110 of the sidewall portion 104. The second sets of ribs 144 along with the first set of ribs 120 provide additional stiffness to the rim portion 112 of the container 100. In the embodiment shown in the figures, see for example FIG. 2, the second set of ribs comprises 5 separate ribs. It should be appreciated that any number of ribs can be added to the second set of ribs 144 according to various embodiments of the present invention. Furthermore, as shown in the figures the ribs of the second set of ribs 144 are arranged between the first and second ribs 120*a*,120*b* of the first set of ribs. Furthermore, it can be seen that the ribs of the second set of ribs 144 are offset from the first and second rib 120*a*,120*b*. Likewise it can be said that the ribs of the second set of ribs 144 are arranged between the first and second cuts 128, 130. It can also be seen that the ribs 144 are offset from the first and second cuts 128, 130. The lid lever 132 also includes at least one support rib 146 which adds to the stiffness of the lid lever 132 as shown in FIG. 3.

The lid lever 132 includes at least one protrusion 148 at its lower edge to occupy the fingers of a user. The number of protrusions 148 can be one, two or three according to various embodiments of the present invention. However, it should be appreciated that in another embodiment there can be any number of protrusions 148. The lid is dislodged when the lid lever 132 is pulled laterally outward towards a free end by inserting fingers into the protrusions 148 without damaging the lid of the container 100.

The presence of the primary skirt 114, the secondary skirt 138 and the design of the lid lever 132 allows a user to effectively open the lid of the container 100 without any damage. The lid lever 132 exerts a load on the primary skirt 114 when it is laterally pulled outward to dislodge the lid. The secondary skirt 138 is configured to support the load exerted onto the primary skirt 114, thereby maintaining the stiffness of the rim portion 112. The secondary skirt 138 prevents deformation of the rim portion 112 and the primary skirt 114, thereby allowing more effective usage of the lid lever 132.

A sectional side view of the portion of the lid lever between the first cut 128 and the second cut 130 along the X-X' axis of FIG. 1 is shown in FIG. 4*a* according to an illustrative embodiment of the present invention. A sectional side view of a portion of the primary skirt 114 along the Y-Y' axis of FIG. 1 is shown in FIG. 4*b* according to an illustrative embodiment of the present invention. In other words, the sectional view of the lid lever 132 is seen in FIG. 4*a* while the sectional view of the primary skirt 114 and the rim portion 112 is seen in FIG. 4*b*.

Figure 5:
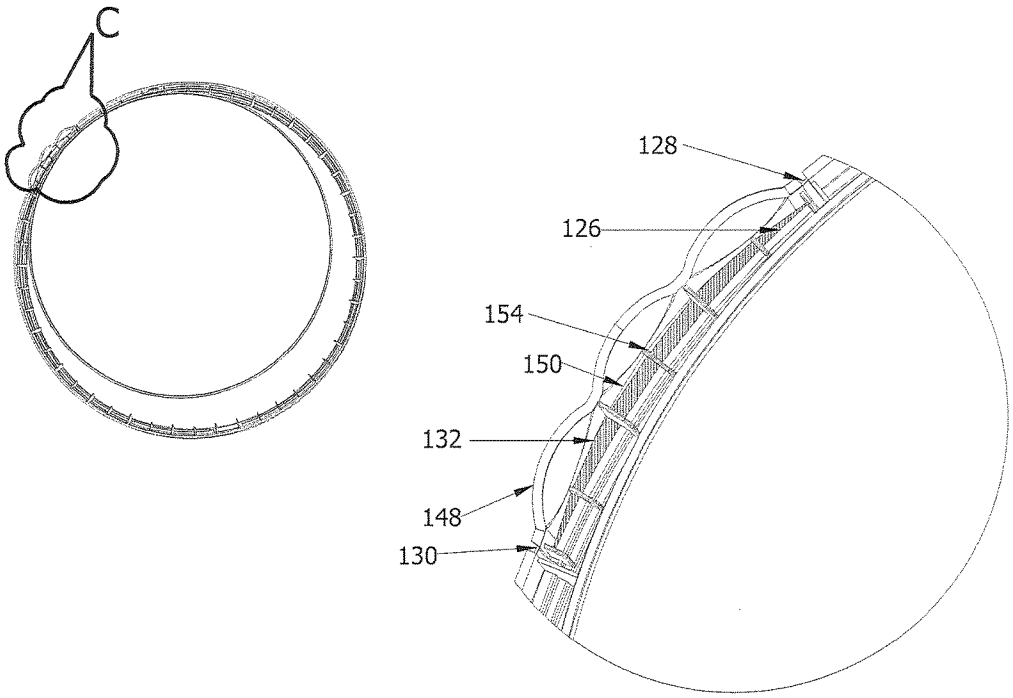
FIG. 5 shows a bottom view of the portion between the first cut and the second cut, according to an illustrative embodiment of the present invention.
Figure 6:
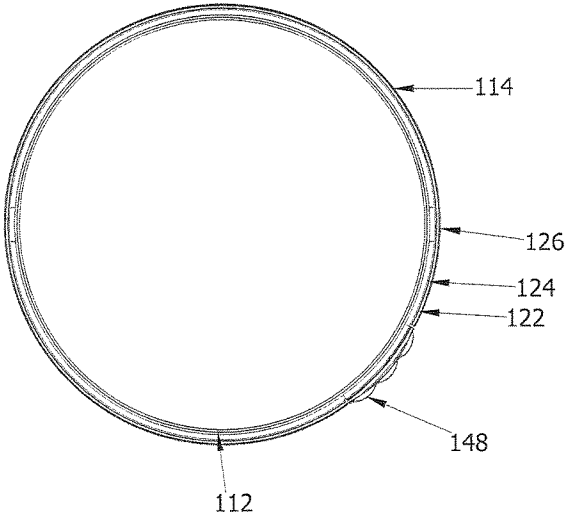
FIG. 6 shows a top view of the container according to an illustrative embodiment of the present invention.

A bottom view of the portion between the first cut 128 and the second cut 130 is shown in FIG. 5 according to an illustrative embodiment of the present invention. The figure shows a hatched portion indicating the extended portion of the lid lever 132. A top view of the container 100 is shown in FIG. 6 according to an illustrative embodiment of the present invention. The lid lower edge engaging surface 122, the inner edge 124 and the outer edge 126 are shown in FIG. 3, FIG. 4*a* and FIG. 4*b*. The area between the inner edge 124 and the outer edge 126 comprises the lid lower edge engaging surface 122. The lid lower edge engaging surface 122 runs parallel with the primary skirt 114 covering the circumference of the container 100.

The lid lever 132 also contains a lid lower edge engaging surface 122. The lid lower edge engaging surface 122 of the lid lever 132 comprises an inner edge and an outer edge 150. It should be noted that the inner edge 124 of the lid lower edge engaging surface 122 of the primary skirt 114 as well as the lid lever 132 coincide along the entire circumference of the container 100. The outer edge 126 of the lid lower edge engaging surface 122 of the primary skirt 114 covers the majority of the circumference of the container 100, but does not include the area between the first cut 128 and the second cut 130. The lid lower edge engaging surface 122 of the lid lever 132 extends past an imaginary circular line (not shown in figures) which is concentric with the outer edge 126 of the primary skirt 114. In other words it can be said that the imaginary circular line and the outer edge 126 are of the same diameter.

It can also be said that, the lid lower edge engaging surface 122 between the first cut 128 and the second cut 130, due to the presence of the lid lever 132 extends to the outer edge 150 as shown in FIG. 3 and FIG. 4*a*. The portion of the lid lower edge engaging surface 122 of the lid lever 132 between the first cut 128 and the second cut 130 has a radial distance 'D'. The radial distance 'D' is the distance measured from the inner edge 124 to the outer edge 150 of the lid lower edge engaging surface 122 of the lid lever 132. Similarly, a radial distance 'd' is the distance measured from the inner edge 124 to the outer edge 126 of the lid lower edge engaging surface 122 of the primary skirt 114. The radial distance 'D' is greater than the radial distance 'd' according to an embodiment of the present invention.

The inner surface 134 of the lid lever 132 and the inner surface 116 of the primary skirt 114 coincide as shown in FIG. 3. A ridge 152 extends from the first edge 150 as shown in FIG. 3. The ridge 152 holds and further prevents the lower edge of the lid from dislodging in event of an application of an external force.

The extended part of the lid lever 132 i.e. the radial distance 'D' gradually increases from the first cut 128 to a midpoint 154 of the portion of the lid lever 132 between the first cut 128 and the second cut 130 and then gradually decreases from the midpoint 154 to the second cut 130 as shown in FIG. 5. The distance from the outer surface 136 of the lid lever 132 to the outer edge 150 of the lid lower edge engaging surface 122 of the lid lever 132 is maximum at the midpoint 154. As the lid lever 132 is integrated in the primary skirt 114 of the container 100, the extended part of the lid lever 132 helps to distinguish the lid lever 132 from the primary skirt 114.

In the figures, the lid lever is shaped with a smooth arc shape. However in another embodiment, the lid lever 132 can be one of many different shapes. For example, in another embodiment, the lid lever could have a shape comprising double arcs, or one could imagine a square shape, etc. . . .

It should be appreciated that the bottom portion 102, the sidewall portion 104, the primary skirt 114, the lid lever 132, and the secondary skirt 138 are all made of the same material according to an embodiment of the present invention. In this case, the bottom portion 102, the sidewall portion 104, the primary skirt 114, the lid lever 132, and the secondary skirt 138 could all be integrally moulded in a single plastic injection moulding operation. The container 100 is preferably manufactured using moulded plastics material. However, the materials can vary with the method of manufacturing.

The present invention has been described herein with reference to a particular embodiment for a particular application. Although selected embodiments have been illustrated and described in detail, it may be understood that various substitutions and alterations are possible. Those having ordinary skill in the art and access to the present teachings may recognize additional various substitutions and alterations are also possible without departing from the spirit and scope of the present invention, and as defined by the following claim.

The invention claimed is:

1. A container (100) having a bottom portion (102); a sidewall portion (104) having an inner surface (108) and an outer surface (110), wherein the sidewall portion (104) defines an opening (106), wherein an upper edge of the sidewall portion (104) has a rim portion (112) for engaging a lid to close the container (100); a primary skirt (114) which extends downwardly from the rim portion (112) of the container (100), wherein the primary skirt (114) has an inner surface (116) and an outer surface (118); wherein first (128) and second (130) cuts are formed in the primary skirt (114), and wherein the primary skirt (114) also comprises a lid lower edge engaging surface (122) having an inner edge (124) and an outer edge (126); and a lid lever (132) having an inner surface (134) and an outer surface (136), wherein the lid lever (132) is arranged in a gap in the portion of the primary skirt (114) defined by the first (128) and the second (130) cuts; wherein the lid lever (132) also comprises a lid lower edge engaging surface (122) having an inner edge (124) and an outer edge (150); and wherein the lid lever (132) is arranged to pivot outwardly about a bending line running parallel with the rim portion (112) of the container (100), and wherein the lid lever (132) is configured in such a way that when a lid is mounted on the container (100), an edge of the lid is lifted upwardly when the lid lever (132) is pulled laterally outwards;

wherein the lid lower edge engaging surface (122) of the lid lever (132) is arranged in such a way that the outer edge (150) of the lid lower edge engaging surface (122) of the lid lever (132) extends outwardly past a circular line which is co-centric with and which has the same diameter as the outer edge (126) of the lid lower edge engaging surface (122) of the primary skirt (114).

2. The container as claimed in claim 1, wherein a radial distance from the inner edge (124) of the lid lower edge engaging surface (122) to the outer edge (150) gradually increases from the first cut (128) to a midpoint (154) and gradually decreases from the midpoint (154) towards the second cut (130) and in that the radial distance of the lid lower edge engaging surface of the lid lever between the first (128) and second (130) cuts is maximum at the midpoint (154) of the portion of the lid lever (132) between the first (128) and second (130) cuts.

3. A container (100) having a bottom portion (102); a sidewall portion (104) having an inner surface (108) and an outer surface (110), wherein the sidewall portion (104) defines an opening (106), wherein an upper edge of the sidewall portion (104) has a rim portion (112) for engaging a lid to close the container (100); a primary skirt (114) having an inner surface (116) and an outer surface (118) extends downwardly from the rim portion (112) of the container (100), wherein first (128) and second (130) cuts are formed in the primary skirt (114), and wherein the primary skirt (114) also comprises a lid lower edge engaging surface (122) having an inner edge (124) and an outer edge (126); a lid lever (132) having an inner surface (134) and an outer surface (136), wherein the lid lever (132) is arranged in a gap in the portion of the primary skirt (114) defined by the first (128) and the second (130) cuts and arranged to pivot outwardly about a bending line running parallel with the rim portion (112) of the container (100), wherein the lid lever (132) also comprises a lid lower edge engaging surface (122) having an inner edge (124) and an outer edge (150) and wherein the lid lever (132) is configured in such a way that when a lid is mounted on the container (100), an edge of the lid is lifted upwardly when the lid lever (132) is pulled laterally outwards; and a secondary skirt (138) present in the gap defined by the first (128) and second (130) cuts, wherein the secondary skirt is arranged as a flange which extends downwardly from the rim portion (112) such that the secondary skirt (138) is arranged between the outer surface (110) of the sidewall portion (104) and the inner surface (134) of the lid lever (132), wherein the secondary skirt (138) comprises a set of ribs (144) extending from an inner surface (140) of the secondary skirt (138) to the outer surface (110) of the sidewall portion (104).

4. The container as claimed in claim 3, wherein the secondary skirt (138) is connected to the primary skirt (114) on either side of the lid lever (132).

5. The container as claimed in claim 3, wherein the primary skirt (114) includes a set of ribs (120) which extend from the inner surface (116) of the primary skirt (114) to the outer surface (110) of the sidewall portion (104) and where a first rib (120*a*) is arranged near the first cut (128) and a second rib (120*b*) is arranged near the second cut (130) and in that the secondary skirt (138) is connected to both the first and the second ribs (120*a*, 120*b*).

6. The container as claimed in claim 3, wherein the bottom portion (102), the sidewall portion (104), the primary skirt (114), the lid lever (132), and the secondary skirt (138) are made of the same material.

7. The container as claimed in claim 3, wherein the bottom portion (102), the sidewall portion (104), the primary skirt (114), the lid lever (132), and the secondary skirt (138) are integrally moulded in a single plastic injection moulding operation.

8. The container as claimed in claim 3, wherein the lid lever (132) includes a free end having at least one protrusion (148), wherein at least one protrusion (148) is configured to provide room for at least one finger of a user for pulling the lid lever (132) to disengage the lid from the container (100).

9. The container as claimed in claim 3, wherein a radial distance from the inner edge (124) to the outer edge (126) of the lid lower edge engaging surface (122) of the primary skirt (114) is less than a radial distance from the inner edge (124) to the outer edge (150) of the lid lower edge engaging surface (122) of the lid lever (132).

10. The container as claimed in claim 3, wherein the ribs of the set of ribs (144) of the secondary skirt (138) are arranged between the first and second cuts (128,130).

11. The container as claimed in claim 10, wherein the ribs of the set of ribs (144) of the secondary skirt (138) are offset from the first and second cuts (120,130).

12. The container as claimed in claim 3, wherein the ribs of the set of ribs (144) of the secondary skirt (138) are arranged between the first rib (120*a*) and the second rib (120*b*) of the set of ribs (120) of the primary skirt (114).

13. The container as claimed in claim 12, wherein the ribs of the set of ribs (144) of the secondary skirt (138) are arranged offset from the first rib (120*a*) and the second rib (120*b*) of the set of ribs (120) of the primary skirt (114).

* * * * *